United States Patent [19]

Nunes et al.

[11] Patent Number: 4,960,377

[45] Date of Patent: Oct. 2, 1990

[54] GAS/AIR MIXING VALVE

[75] Inventors: Maurice Nunes, Arlington; Michael P. Grimanis, Medford; James R. Hurley, Weymouth; Kailash C. Shukla, Stow, all of Mass.

[73] Assignee: Gas Research Insitute, Chicago, Ill.

[21] Appl. No.: 353,024

[22] Filed: May 17, 1989

[51] Int. Cl.[5] ..... F23N 1/02

[52] U.S. Cl. ..... 431/12; 431/354; 431/174; 137/583; 137/606

[58] Field of Search ..... 431/354, 12, 89, 90, 431/75, 62, 19, 63, 159, 174, 178; 137/606, 207, 583; 126/93, 92 C, 92 R, 39 E, 21 A, 15 A, 15 R; 415/27; 417/307, 310

[56] References Cited

U.S. PATENT DOCUMENTS

| | | | |
|---|---|---|---|
| 3,229,748 | 1/1966 | Spielman | 431/354 |
| 4,008,039 | 2/1977 | Compton et al. | 431/90 |
| 4,622,946 | 11/1986 | Hurley et al. | 126/39 |

FOREIGN PATENT DOCUMENTS

| | | | |
|---|---|---|---|
| 2312305 | 9/1974 | Fed. Rep. of Germany | 431/354 |
| 944714 | 12/1959 | United Kingdom | 415/27 |

*Primary Examiner*—Carl D. Price
*Assistant Examiner*—F. H. Stephan
*Attorney, Agent, or Firm*—Lorusso & Loud

[57] ABSTRACT

A gas/air mixing valve is provided for regulating the amounts of combustion air and fuel gas that are delivered to a burner or a series of burners for use with both residential and commerical cooking ranges. The mixing valve overcomes the problem of pressure disturbances caused by known mixing valves by drawing a constant flow of combustion air regardless of whether the burner to which it is supplying fuel gas and air is off or operating at any intensity level. In a preferred embodiment the mixing valve is provided with an adjustable orifice disk which directs a constant flow or air, in selectable proportions, to either combine in the mixing valve with fuel gas for combustion or bleed to atmosphere. By always drawing a constant flow of air independently of the operating level of the burner, the mixing valve allows adjustment of individual burners with no effect on other burners connected to the system.

7 Claims, 4 Drawing Sheets

GAS/AIR MIXING VALVE

BACKGROUND OF THE INVENTION

The present invention relates to a compact, low cost air/fuel mixing valve of the type used in, among other places, commercial and residential cooking ranges that are gas-fueled.

In gas-fueled commercial and residential open top burners, natural gas is introduced at low pressure and mixed with air from a blower. Turndown for each burner is individually controlled after ignition, as from a constantly burning pilot which serves all burners. A source of flame instability and thus inefficient burning has been pressure disturbances caused by gas/air mixer valves being opened and closed to activate or adjust burners.

With known gas/air mixing valves, when a burner corresponding to a valve is desired to be activated, that valve must be opened to allow combustion air to be mixed with gas fuel. Since when not in operation known mixing valves do not draw on the supply of combustion air at all, when the valve is opened it creates a disturbance within the entire combustion air system. This is because the newly opened valve must now either use combustion air that was previously flowing to other burners in the system, thereby decreasing the supply of combustion air available to those other burners, or the combustion air supply means must be triggered to increase its supply. Even when the burner system is of sufficient sophistication to signal for a greater supply of air, the increase will necessarily result in pressure fluctuations which wreak havoc with the burner's efficiency and stability.

In order to compensate for pressure disturbances caused when mixing valves are either first opened or adjusted, known gas-fueled burner systems are often built with combustion air manifolds that are large. This is done to minimize the impact of a pressure drop across one or more mixing valves connected to the manifold. This practice of employing large manifolds to deliver combustion air to burner mixing valves is not, however, without problems.

An important requirement of both commercial and residential cooking ranges is that they be as compact as possible. While the commercial user is driven by the notion that space is money, the residential cooking range user does not welcome any unnecessary invasion of his crucial living space. Accordingly, the awkward and bulky manifold designs offered to compensate for pressure disturbances experienced with known mixing valves have not been satisfactory. Also, even though these large manifolds are able to diminish the impact of mixing valve-induced pressure disturbances, those pressure disturbances have not been eliminated. This continues to create problems, particularly for power burner-type cooking ranges utilizing pressurized combustion air, which are more sensitive to these disturbances than are standard gas-fueled ranges.

It is therefore an object of the present invention to provide a mixing valve for use with gas-fueled cooking ranges that would otherwise be subject to pressure disturbances during ignition or adjustment of a corresponding burner flame.

It is also an object of the present invention to provide such a mixing valve that is compact and easy to manufacture.

It is yet another object of the present invention to provide such a mixing valve that will not require substantial design changes in the other components of the gas-fueled cooking ranges in which it is to be used.

It is still another object of the present invention to enable commercial and residential cooking ranges to burn more efficiently and stably.

SUMMARY OF THE INVENTION

The problems of known mixing valves are greatly mitigated by the system of the present invention which is a gas/air mixing valve which draws a constant supply of combustion air regardless of whether its corresponding burner is off or operating at full or partial power. By diverting a constant supply of combustion air, in varying proportions, to either a corresponding burner or to atmosphere, the present invention is able to virtually eliminate the negative consequences of pressure disturbances on gas-fueled cooking ranges by reducing those pressure disturbances to a minimum.

The gas/air mixing valve in accordance with the present invention has adjustable orifice means, preferably a rotatable orifice disk, that directs the flow of combustion air to either mix with fuel gas or vent to atmosphere. By rotating the orifice disk in either a clockwise or counter-clockwise direction, the user can direct the constant flow of combustion air to mix with the fuel gas in varying proportions. By redirecting a constant flow of combustion air rather than turning a combustion air supply line off and on, or otherwise varying its flow, the present invention is able to maintain a steady pressure across the mixing valve and thereby allow the cooking range with which it is being used to burn more stably and efficiently.

The compact construction of the present invention avoids pressure disturbances without the need for drastic redesign of cooking ranges. Unlike known solutions involving large combustion air manifolds, the mixing valve of the present invention can be fit to function with cooking ranges in such a manner that no additional space is required.

The advantages and function of the present invention can best be understood by making reference to the description below in cooperation with the appended drawing in which like reference numbers refer to like members.

DESCRIPTION OF PREFERRED EMBODIMENTS

The gas/air mixing valve of the present invention is intended for use with either commercial or residential powered, gas-fueled cooking ranges. It has the advantage over known mixing valves of virtually eliminating pressure drops which occur across such valves when a combustion air inlet port is opened. By operating with a constant pressure source of combustion air to either mix with fuel gas for burning or bleed to atmosphere, the mixing valve of the present invention avoids the deleterious effects of pressure bursts and drops caused by altering the pressure of the combustion air supply as is done by known mixing valves.

Figure 1:
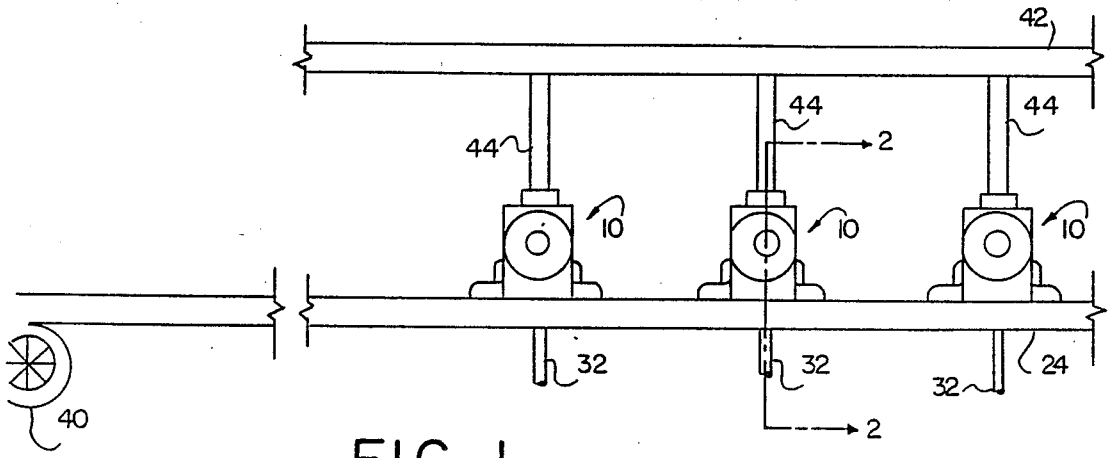
FIG. 1 is a schematic representation of a section of a typical gas manifold-air plenum configuration for a combustion system incorporating the mixing valve of the present invention.

As is shown in FIG. 1, the mixing valve 10 of the present invention is connected to an air plenum 24 within which a supply of combustion air is maintained at a constant pressure. Generally, several such mixing valves 10 will be used in a typical cooking range application each of which will be connected to the same air plenum 24. The number of mixing valves 10 will correspond to the number of cooking burners (not shown) so that each cooking burner can be adjusted independently of other cooking burners which are connected to the system. This configuration allows for maximum flexibility while using the cooking range. A system could be configured, however, so that one gas/air mixing valve 10 in accordance with the present invention supplied a mixture of combustion gas and air to all or several burners in the system. By so doing, it would be possible to ensure that all or several of the burners burned uniformly.

It is in a system utilizing a plurality of mixing valves 10 to individually supply a mixture of combustion gas and air to a corresponding plurality of cooking burners, however, that one of the chief advantages of the present invention is realized. Were a single mixing valve connected to the air plenum 24, a pressure disturbance created by the mixing valve would manifest itself by causing flame fluctuation in all cooking burners. By contrast, use of a mixing valve 10 for each burner results in a cooking range in which adjustment of one burner has no effect on the other burners.

Further visible in FIG. 1 is a blower 40 in communication with the air plenum 24 and which may, for example, be mounted in the back of the cooking range. The air plenum 24 will generally be of a rectangular cross-section and extend across substantially the entire width of the cooking range. The blower 40 and valves 10 are operated to ensure that the flow of air through the plenum 24 is constant. In accordance with the present invention, regardless of how many burners are operating, or at what intensity, the blower 40 will deliver a constant supply of air to the plenum 24.

Figure 2:
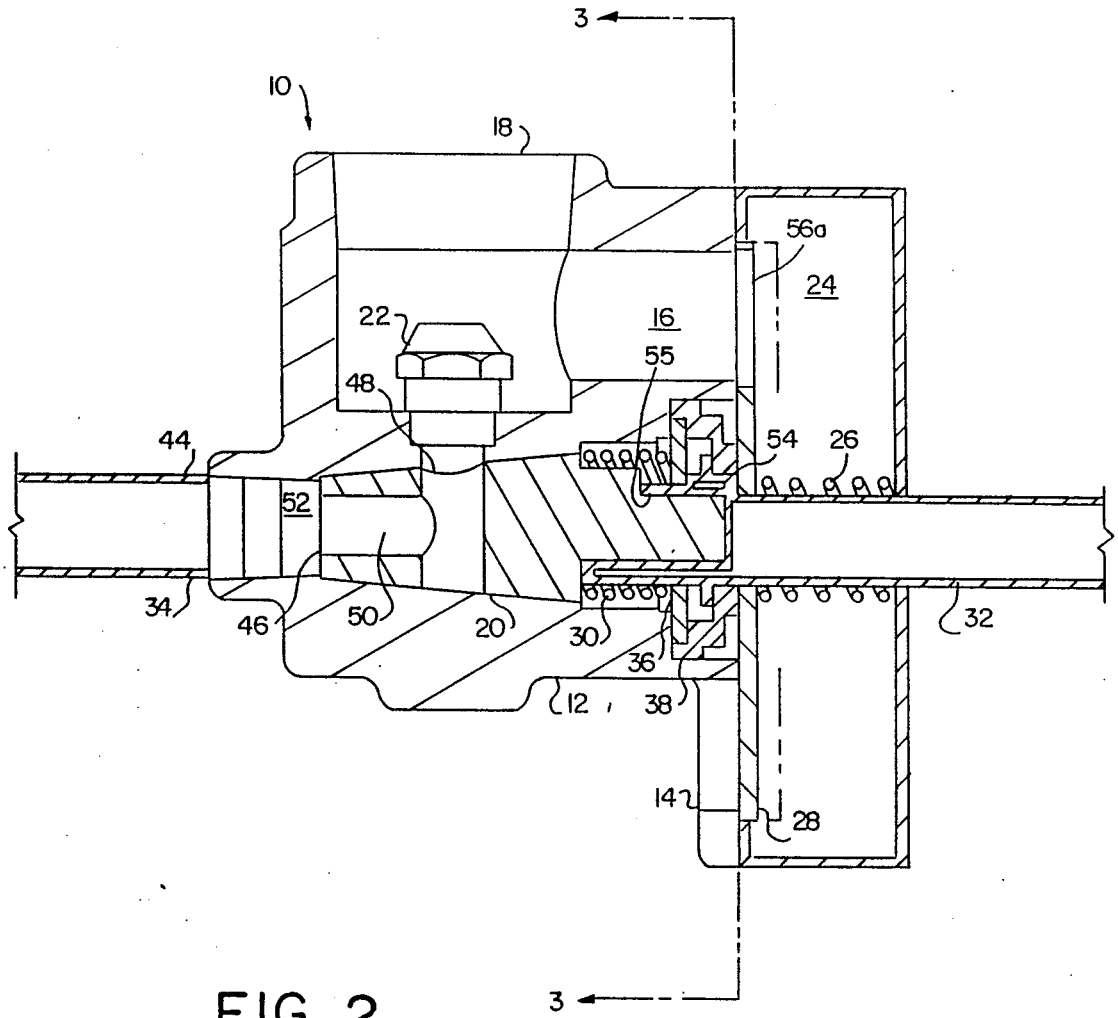
FIG. 2 is a cross sectional view taken along line II—II of FIG. 1 of the mixing valve in accordance with a preferred embodiment of the present invention.

FIG. 2 shows in detail the inner workings of a mixing valve 10 in accordance with a preferred embodiment of the present invention. Opposite to the side of the mixing valve 10 which is connected to the plenum 24, each mixing valve 10 is provided with a combustion gas inlet port 34. In a typical cooking range, a single gas manifold 42 (FIG. 1) is provided, to which a separate gas fitting or inlet tube 44 is connected for each mixing valve 10. Typically, the gas fitting or inlet tube 44 is provided with an outer thread on the end which is to be connected to the combustion gas inlet 34 formed in a valve body 12 of each mixing valve 10. This outer thread is formed to mate with an inner thread on the combustion gas inlet 34.

Juxtaposed to the combustion gas inlet 34 of the mixing valve 10 is a valve plug 20 which prevents combustion gas from traveling directly through the mixing valve 10. The valve plug 20 is roughly conical or frustrum-shaped and occupies a chamber defined by the valve body 12 which allows for rotational movement about a longitudinal axis 50 of the plug 20 but prevents transverse movement of the plug 20 toward the combustion gas inlet 34. The plug 20 is further held in position by a retaining spring 30 which exerts a force against the plug 20 constantly urging it toward the combustion gas inlet 34.

The plug 20 defines two channels which enable it to regulate the flow of combustion gas into a gas/air mixing chamber 18 defined by the valve body 12. The two channels form a "T" pattern. The first channel referred to as the plug inlet channel 46, is formed coaxially with the longitudinal axis 50 of the plug 20. The plug inlet channel 46 has an open end in communication with the inlet port 52 formed by the combustion gas inlet 34 so that any gas which is introduced into the inlet port 52 will travel into the plug inlet channel 46 regardless of the rotational orientation of the plug 20.

Perpendicularly to the plug inlet channel 46 there is formed a plug outlet channel 48 which intersects the plug inlet channel 46 and completely traverses the plug 20 diameter so as to have two open ends. Depending on the rotational orientation of the plug 20, therefore, an open end of the plug outlet channel 48 will either be aligned with a gas orifice 22 or partially or fully blocked by the valve body 12. When an end of the plug outlet channel 48 is aligned with the calibrated gas orifice 22, any gas which has flowed from the the gas inlet port 52, to the plug inlet channel 46 and into the plug outlet channel 48 will be able to then flow into the gas/air mixing chamber 18 to be mixed with air in preparation for combustion. When neither end of the plug outlet channel 48 is aligned with the gas orifice 22 but is blocked by the valve body 12, no gas will be allowed to escape from the plug outlet channel 48 and the entire valve 10 therefore will be said to be in an "off" condition. That is to say that no combustion gas from the gas manifold 42 will be supplied to the cooking burner corresponding to that mixing valve 10.

The means by which the rotational orientation of the valve plug 20 is controlled is a valve stem 32 which projects through the air plenum 24 and enters into the valve body 12 to engage an interfitting male element 54 of the valve plug 20. The valve stem 32 is provided with a female end 55 to receive the interfitting male element 54 of the valve plug 20. The interfitting male element 54 and female end 55 of the valve stem 32 are shaped to allow insertion, but prevent any relative rotational movement of the valve stem 32 and the valve plug 20. As a result, any rotation of the valve stem 32 will cause an equivalent angular displacement of the valve plug 20.

Further evident from FIG. 2 are the valve plug retaining spring brace 36 and the valve stem mount 38 which help to position both the valve plug 20 and the valve stem 32. Both the brace 36 and the mount 38 are annularly shaped to allow the female end 55 of the valve stem 32 to pass through and engage the interfitting male element 54 of the valve plug 20. The retaining spring brace 36 acts as a foundation against which the retaining spring 30 can push to urge the valve plug 20 toward the gas inlet 34. Moreover, the valve stem mount 38 works in cooperation with an orifice disk 28 and and orifice disk retaining spring 26 to keep the retaining spring brace 36 properly positioned.

An important inventive concept of the mixing valve 10 of the present invention is the way in which the orifice disk 28, the valve stem 32, a combustion air inlet orifice 16, and a bleed air orifice 14 all cooperate to ensure that regardless of the rotational orientation of the valve stem 32, the flow of air passing through the air plenum 24 is constant. It is in this manner that the mixing valve 10 of the present invention is able to ensure more stable burning than known mixing valves which when opened or closed change the pressure of combustion air supplied to a burner.

The orifice disk 28 is positioned so that its outer diameter circumscribes the outermost points of both the combustion air inlet orifice 16 and the bleed air orifice 14. As a result, in order for air to escape from the plenum 24, it must pass through holes which are provided in the orifice disk 28, such as those which are defined by the cutouts **56*a* and 56*b* depicted in FIG. 3. The holes are arranged on the orifice disk 28 so that as the orifice disk 28 is angularly displaced, the exposure of the combustion air inlet orifice 16 changes inversely proportionally to the exposure of the bleed air orifice 4**.

That is to say that when the orifice disk 28 is positioned so that cutout **56*a* completely exposes the combustion air inlet orifice 16, thereby allowing all of the air flowing through the valve 10 from the air plenum 24 to enter into the combustion air inlet orifice 16 to mix with combustion gas, the bleed air orifice 14 will be completely shut off from the air plenum 24. This is the position in which the orifice disk 28 is oriented in FIG. 3. On the other hand, when the orifice disk 28 of the valve 10 is rotated in the direction of arrow 29 toward the "off" position, no combustion gas will be allowed to pass from the plug 20 through the gas 22 and into the mixer chamber 18. Also, orifice disk 28 will completely cover the combustion air inlet orifice 16 and cutout 56*b* will completely expose the bleed air orifice 14 to allow all of the air flowing through the valve 10 from the air plenum 24** to bleed to atmosphere.

As previously discussed, the valve stem 32 is constructed and positioned so that any angular displacement of the valve stem 32 necessarily results in an equivalent angular displacement of the valve plug 20. This is also true of the relationship of the valve stem 32 and the orifice disk 28. As a result, when the valve stem 32 is rotated, both the valve plug 20 and the orifice disk 28 will experience an equivalent rotation.

The holes defined by the cutouts **56*a* and 56*b* in the orifice disk 28 are accordingly shaped and positioned so that as the valve plug 20 is rotated to allow increased gas flow into the mixing chamber 18, so too the orifice disk 28 allows a proportional increase in combustion air into the mixing chamber 18. Through this rotation, the orifice disk 28 also creates a corresponding decrease in air flow out of the bleed air orifice 14. The blower 40 is calibrated and the orifices sized so that the air pressure inside of the air plenum 24** is equivalent to a single pressure level, which typically is in the range of about 0.5 to 3.0 inches of water.

Figure 3:
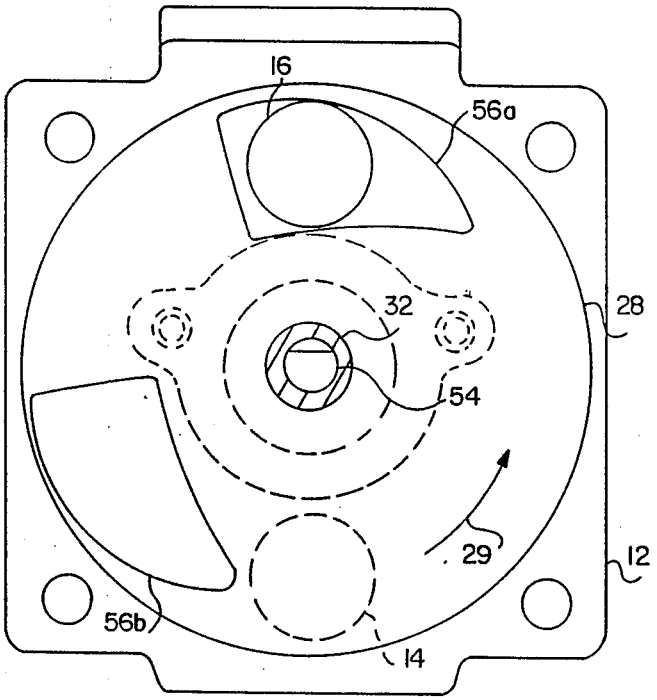
FIG. 3 is a view in the direction of line III—III of FIG. 2 showing a typical hole configuration of an orifice disk of the present invention in a fully open position.
Figure 4:
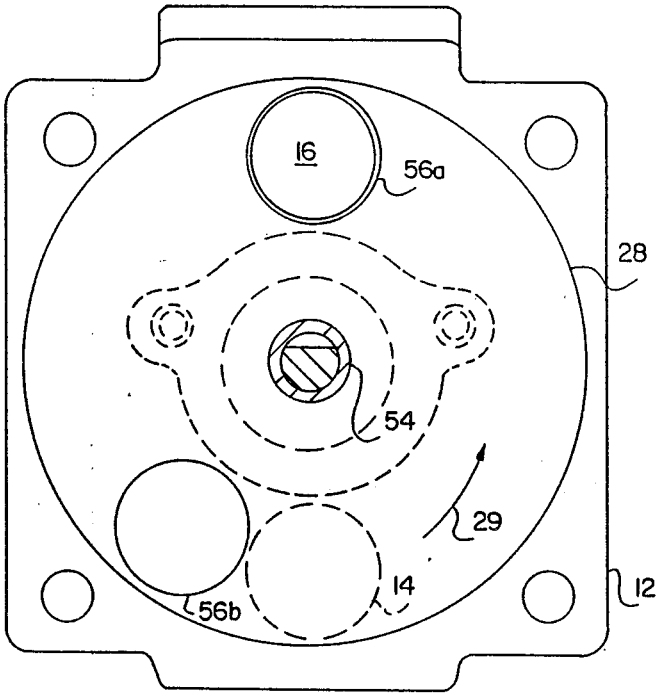
FIG. 4 is a view similar to FIG. 3 but showing an alternate hole configuration of the orifice disk.

Other possible hole configurations, such as that depicted in FIG. 4, will produce results similar to those achieved by those illustrated in FIG. 3. Any such configuration in which rotation of the orifice disk 28 causes an increase of exposure of either the combustion air inlet orifice 16 or the bleed air orifice 14 and a corresponding decrease of exposure of the other is embraced by the present invention. The configurations of the holes in the orifice disk 28 of FIGS. 3, and 4 are meant, therefore, by way of example rather than of limitation.

Many other embodiments which will be readily apparent to those skilled in the art may be made without materially departing from the spirit and scope of this invention. The invention, therefore, is to be defined not by the preceding examples but by the claims that follow.

What is claimed is:

1. A gas/air mixing valve for connection to an air plenum to regulate the flow of combustion reactants to a burner, comprising:

a valve body defining a gas inlet for receiving a supply of combustion gas, a combustion air inlet orifice in communication with the air plenum for receiving a supply of air for combustion, a bleed air orifice in communication with the air plenum for receiving air from the air supply which is not wanted for combustion and venting the unwanted air to atmosphere, and a gas/air mixing chamber for mixing the combustion gas with the air flowing through the combustion air inlet orifice prior to combustion;

means for passing a constant total flow of air from said air plenum through said combustion air inlet orifice and said bleed air orifice; and means for varying the proportions of air flowing through said orifices so as to vary the amount of air flowing to atmosphere and the amount of air mixing with combustion gas for combustion.

2. The gas/air mixing valve as set forth in claim 1, wherein said means for passing a constant total flow of air from said air plenum through said combustion air inlet orifice and said bleed air orifice is an adjustable orifice disk mounted adjacent to said orifices and defining a plurality of holes, said adjustable orifice disk capable of being adjusted to position the holes so that air from the air supply can be directed in varying proportions to said combustion air inlet orifice and said bleed air orifice.

3. The gas/air mixing valve as set forth in claim 2, wherein said means for varying the proportions of air is a valve stem which passes through said adjustable orifice disk and is shaped so that an angular displacement of said valve stem results in an equivalent angular displacement of said adjustable orifice disk.

4. The gas/air mixing valve as set forth in claim 1, further comprising a valve plug defining a first aperture in communication with said combustion gas inlet and a second aperture perpendicular to and in communication with said first aperture, said second aperture also adjustably in communication with said gas/air mixing chamber so that said valve plug can be rotated to either allow or prevent combustion gas from traveling from said combustion gas inlet to said gas/air mixing chamber.

5. A method for regulating the flow of combustion gas and air to a burner for combustion comprising:

providing a gas/air mixing valve comprising a valve body which defines a gas inlet for receiving a supply of combustion gas, a combustion air inlet orifice in communication with an air plenum for receiving a supply of air from that air plenum to be used for combustion, a bleed air orifice in communication with the air plenum for receiving air from the air plenum which is not wanted for combustion and venting the unwanted air to atmosphere, and a gas/air mixing chamber for mixing the combustion gas with the air flowing through the combustion air inlet orifice prior to combustion, said gas/air mixing valve further comprising an adjustable orifice disk mounted adjacent to said combustion air inlet orifice and said bleed air orifice, said adjustable orifice disk defining a plurality of holes such that said orifice disk can be positioned to direct air in varying proportions to said combustion air inlet orifice and said bleed air orifice, and means for adjusting said adjustable orifice disk;

attaching said gas/air mixing valve to said air plenum so that said combustion air inlet orifice and said bleed air orifice are capable of being in communication with said air plenum based on the positioning of said orifice disk and its plurality of holes;

providing a constant flow of air to said air plenum;

providing a supply of combustion gas to said gas inlet of said mixing valve;

adjusting said adjustable orifice disk to direct a desired supply of air into said combustion air inlet orifice to be mixed with gas for combustion and to direct unwanted air into said bleed air orifice to be vented to atmosphere.

6. A system for providing a selectable ratio of combustion gas and air to a series of burners comprising:

means for providing combustion gas;

means for providing a constant flow of air from which a selectable first portion of air can be drawn for combustion and a remaining second portion can be bled to atmosphere;

at least one mixing valve comprising a valve body which defines a gas inlet in communication with said means for providing combustion gas, a combustion air inlet orifice in adjustable communication with said means for providing a constant flow of air for receiving the first portion of air to be used for combustion, a bleed air orifice in adjustable communication with said means for providing a constant flow of air for receiving said second portion of air and bleeding it to atmosphere, and a gas/air mixing chamber for mixing the combustion gas with the first portion of air and delivering the mixture to at least one burner in the series of burners;

a means for selecting said first portion of air for combustion and for delivering said second portion of air to said bleed air orifice.

7. The system as set forth in claim 6 wherein said means for selecting said first portion of air and for delivering said second portion of air to said bleed air orifice is an adjustable orifice disk mounted adjacent to said orifices and defining a plurality of holes, said adjustable orifice disk capable of being adjusted to position the holes so that air from the constant air supply can be directed in varying proportions to said combustion air inlet orifice to form said first portion of air and to said bleed air orifice to form said second portion of air.

* * * * *